US011807968B2

(12) United States Patent
Craig

(10) Patent No.: US 11,807,968 B2
(45) Date of Patent: Nov. 7, 2023

(54) SEWING MACHINE TABLE

(71) Applicant: Barbara Craig, San Pedro, CA (US)

(72) Inventor: Barbara Craig, San Pedro, CA (US)

( * ) Notice: Subject to any disclaimer, the term of this patent is extended or adjusted under 35 U.S.C. 154(b) by 31 days.

(21) Appl. No.: 17/687,672

(22) Filed: Mar. 6, 2022

(65) Prior Publication Data

US 2023/0279597 A1 Sep. 7, 2023

(51) Int. Cl.
*D05B 39/00* (2006.01)
*D05B 35/10* (2006.01)
*D05B 35/12* (2006.01)

(52) U.S. Cl.
CPC ..... *D05B 39/00* (2013.01); *D05B 35/10* (2013.01); *D05B 35/12* (2013.01)

(58) Field of Classification Search
CPC ..... D05B 75/00; D05B 75/02; D05B 75/06; D05B 35/02; D05B 35/04; D05B 35/10; D05B 35/12; D05B 73/00; D05B 73/04; D05B 73/06; D05B 73/08; D05B 73/10; D05B 73/12; D05B 39/00; D05B 97/02; A47B 29/00
See application file for complete search history.

(56) References Cited

U.S. PATENT DOCUMENTS 303,511 A * 8/1884 Hart ..... D05B 35/08 112/146
653,322 A * 7/1900 Strong ..... D05B 35/08 112/146
2,220,868 A * 11/1940 Stein ..... D05B 75/02 112/217.4
2,966,129 A * 12/1960 Ratliff ..... D05B 35/08 112/146
5,052,316 A * 10/1991 Sakakibara ..... D05B 39/00 112/155
11,028,511 B1 * 6/2021 Neill ..... D05B 39/00

FOREIGN PATENT DOCUMENTS

FR 493242 A * 8/1919 ..... D05B 35/12
FR 909568 A * 5/1946 ..... D05B 3/06

OTHER PUBLICATIONS

UWE, UT341AC Flatbed, Dec. 4, 2021, http://uwe.store/collections/flatbed-tables/products/ut341-flatbed-for-juki-ls-341-class-machines (accessed via archive.org). (Year: 2021).*

* cited by examiner

*Primary Examiner* — Patrick J. Lynch
(74) *Attorney, Agent, or Firm* — Lewis M Brande

(57) ABSTRACT

A table for use with sewing machines that attaches to the sewing machines with screws. The table has slidably attached guide plates allowing a user to have more consistent seam lines. The guide plates have provisions to provide clearance to the presser foot of a sewing machine when moved closer together. The table has ruled markings to precisely set the seams with the use of the guide plates. The guide plates are configured to be used with sewing machines. The slide plates have graded markings a depicted on the table.

18 Claims, 10 Drawing Sheets

SEWING MACHINE TABLE

I. BACKGROUND OF THE INVENTION

1. Field of the Invention

This invention relates generally to a removable table for a sewing machine that has accurate graded or ruled markings and adjustable guides that allows a user to sew straight seams and stitches.

2. Description of the Prior Art

The current state of the art tables for sewing machines comes generally in 2 (two) styles. For sewing machines that have flat beds, the table is an extension of the flat bed and is typical of the style of sewing machines that are more common such as Singer® or other brands. For sewing machines that have "free arm" or "cylinder arm" styles, the manufacturer has a table that is attached by using a threaded rod in the table, and is inserted in holes on the mounting base of the sewing machine. The major problem with this prior art is that it is difficult to remove when not required, is very unstable because it only has 3 points of contact on the mounting base but does not have any direct contact with the sewing machine cylinder arm and doesn't provide any guides for straps and/or hems, and is very heavy The instant invention solves these issues by being very light and attached onto the sewing machine casting (case) with at least one screw. The invention has a central cutout around the throat plate and the bobbin slide plate and is trimmed to provide positive support around the machine arm because the sewing machine has angled sides and front surfaces providing a positive lock when the inventors table is installed.

Other aspects and advantages of the invention will be apparent from the description and claims that follow.

II. BRIEF DESCRIPTION OF THE DRAWINGS

Figure 1:
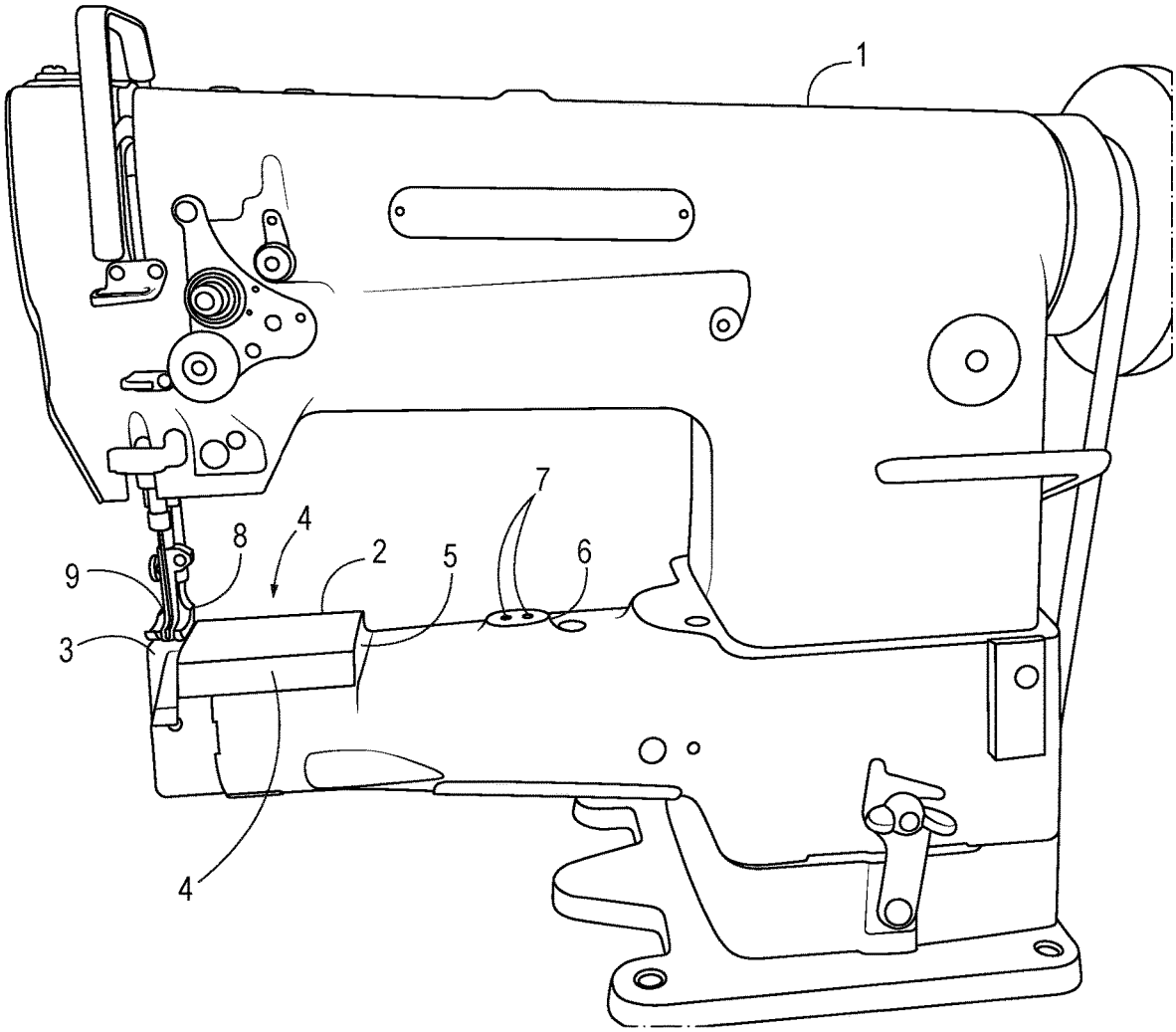

FIG. 1. Shows an overall view of a typical sewing machine.

Figure 2:
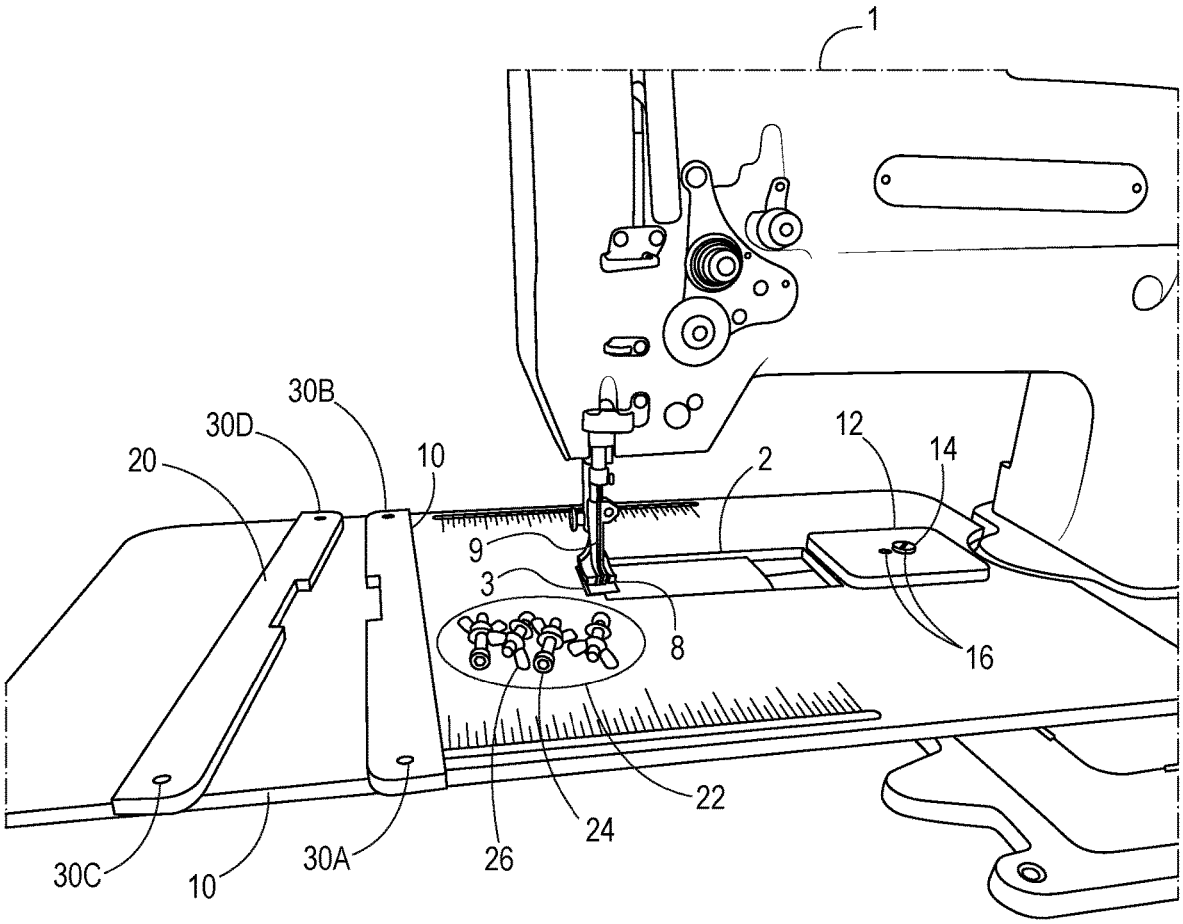

FIG. 2. Shows the sewing machine with the invention installed.

Figure 3:
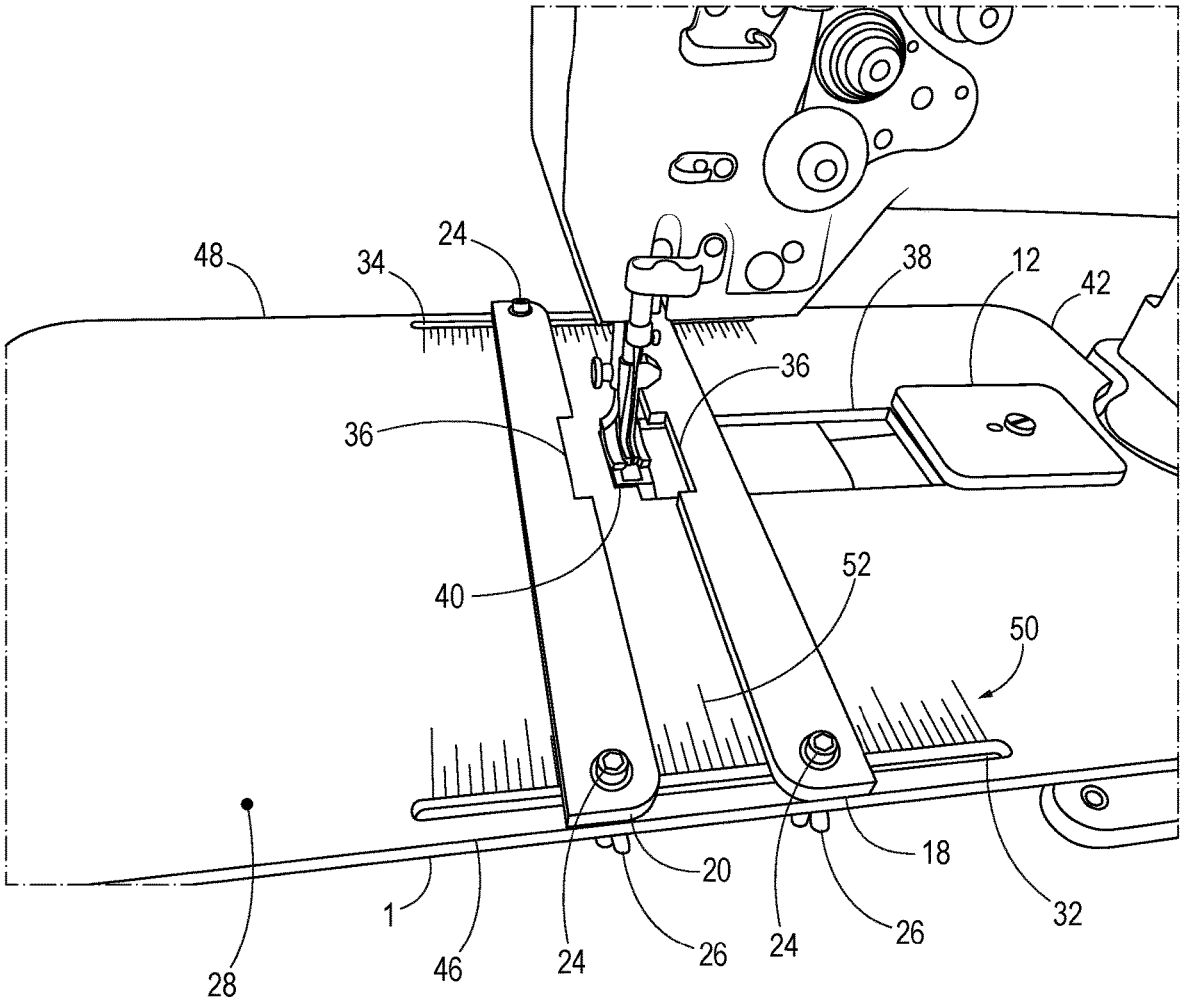

FIG. 3. Shows the sewing machine with the invention installed and the guide plates installed.

Figure 4:
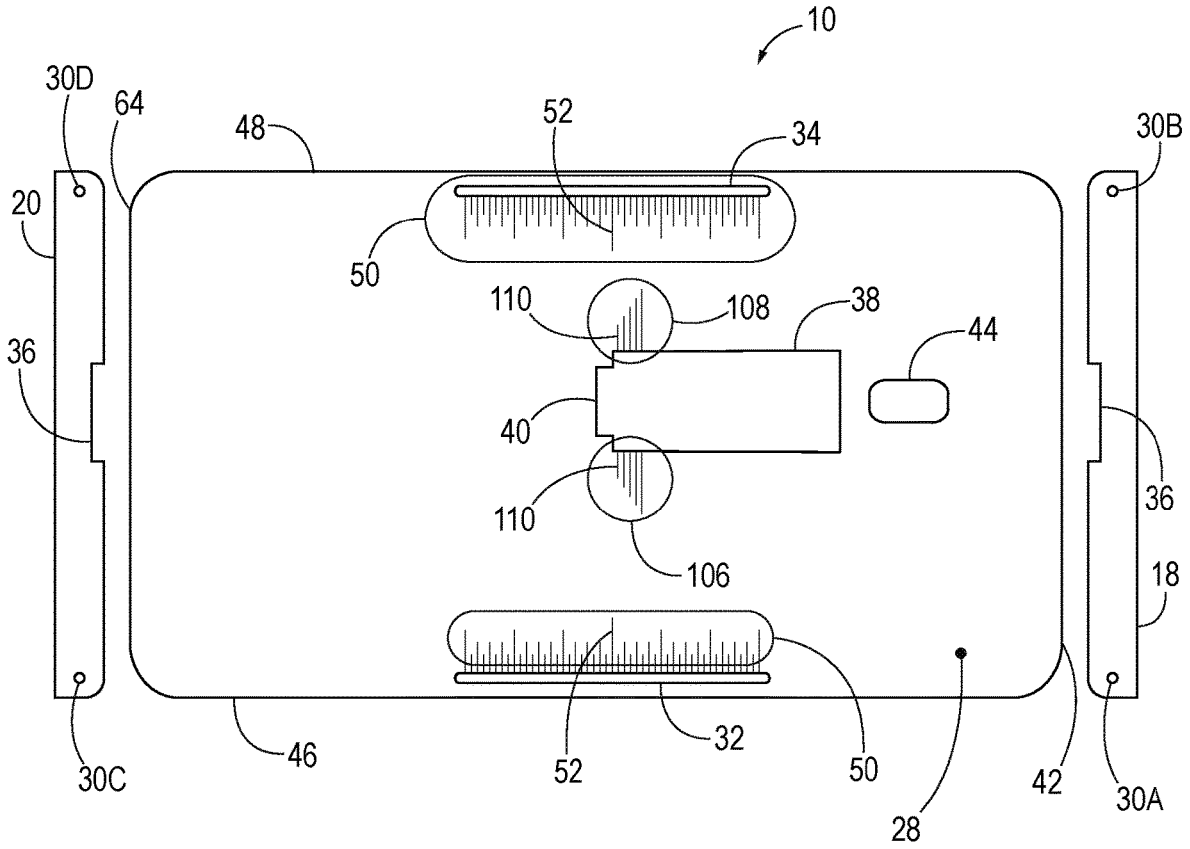

FIG. 4. Shows a plan view of the invention with the guide plates.

Figure 5:
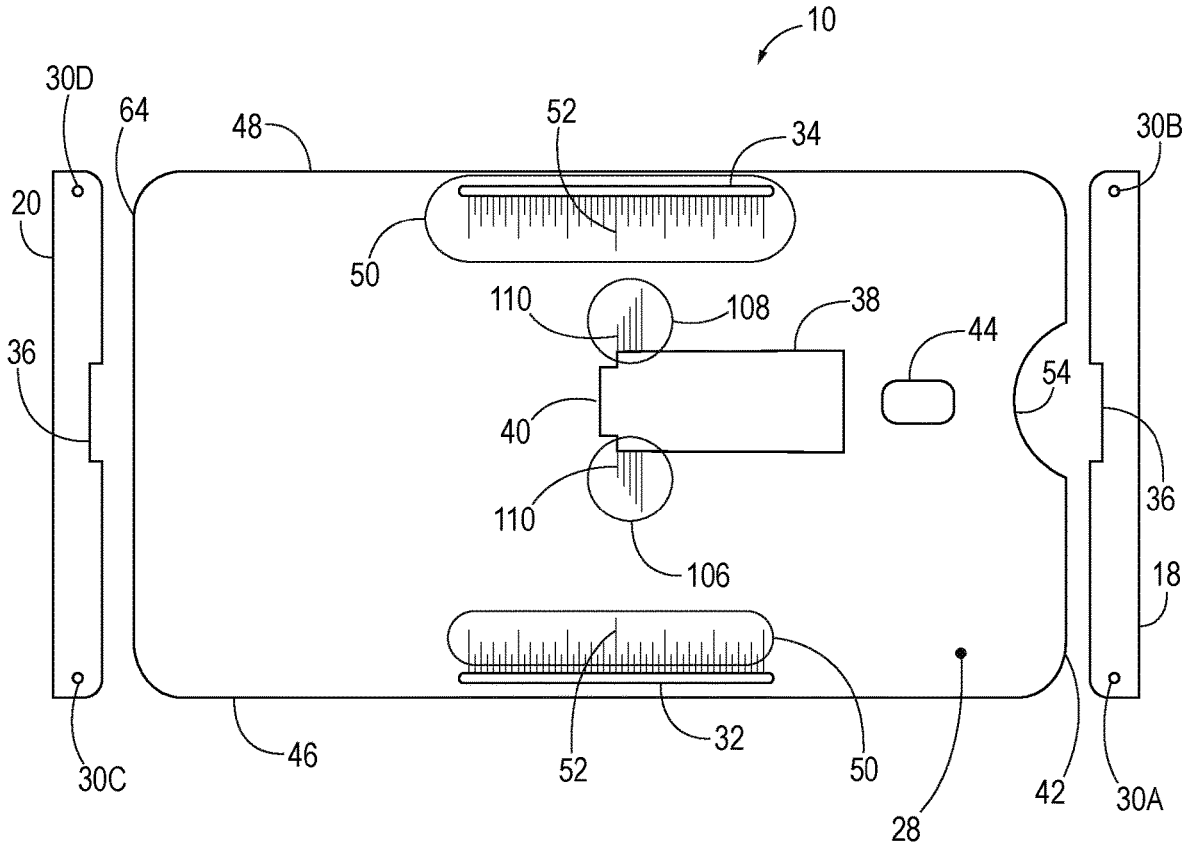

FIG. 5. Shows a plan view of the invention having an additional edge trim and showing the guide plates.

Figure 6:
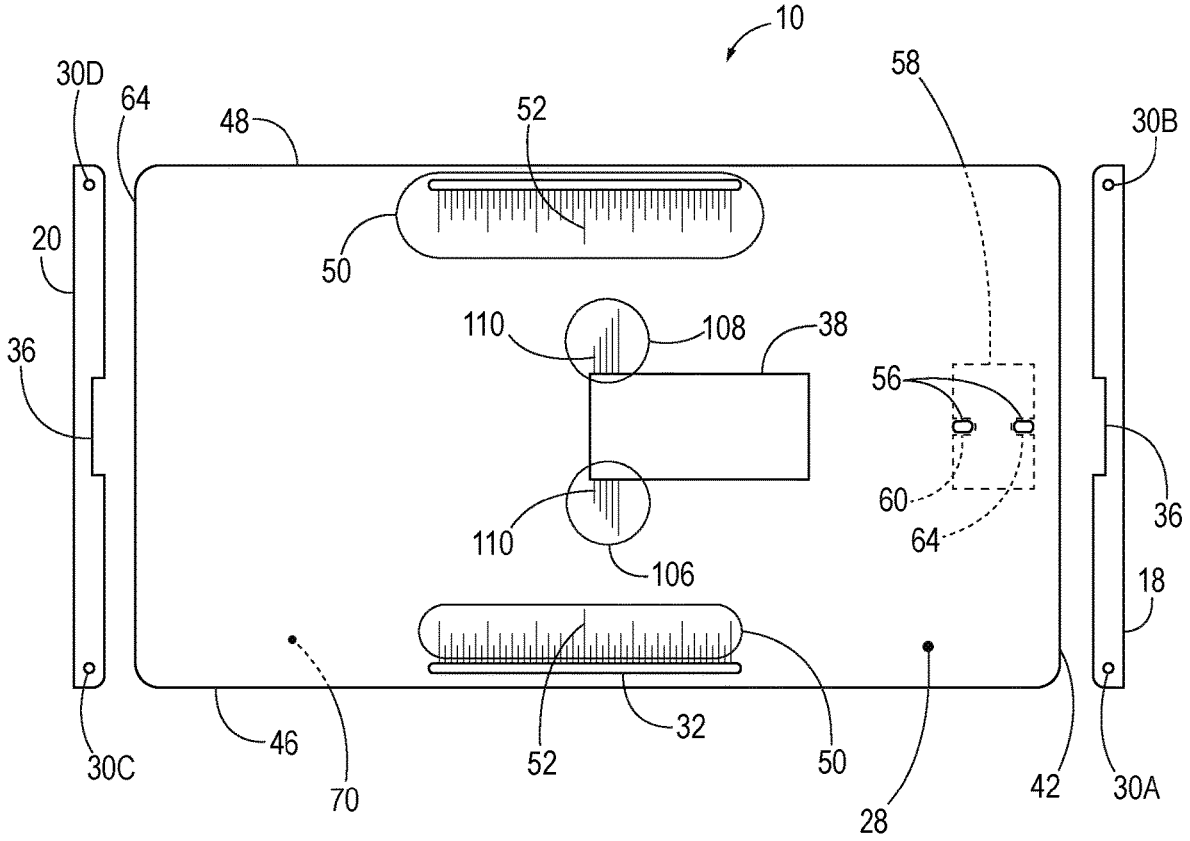

FIG. 6. Shows a plan view of the invention with the guide plates and a simple rectangular cutout.

Figure 7:
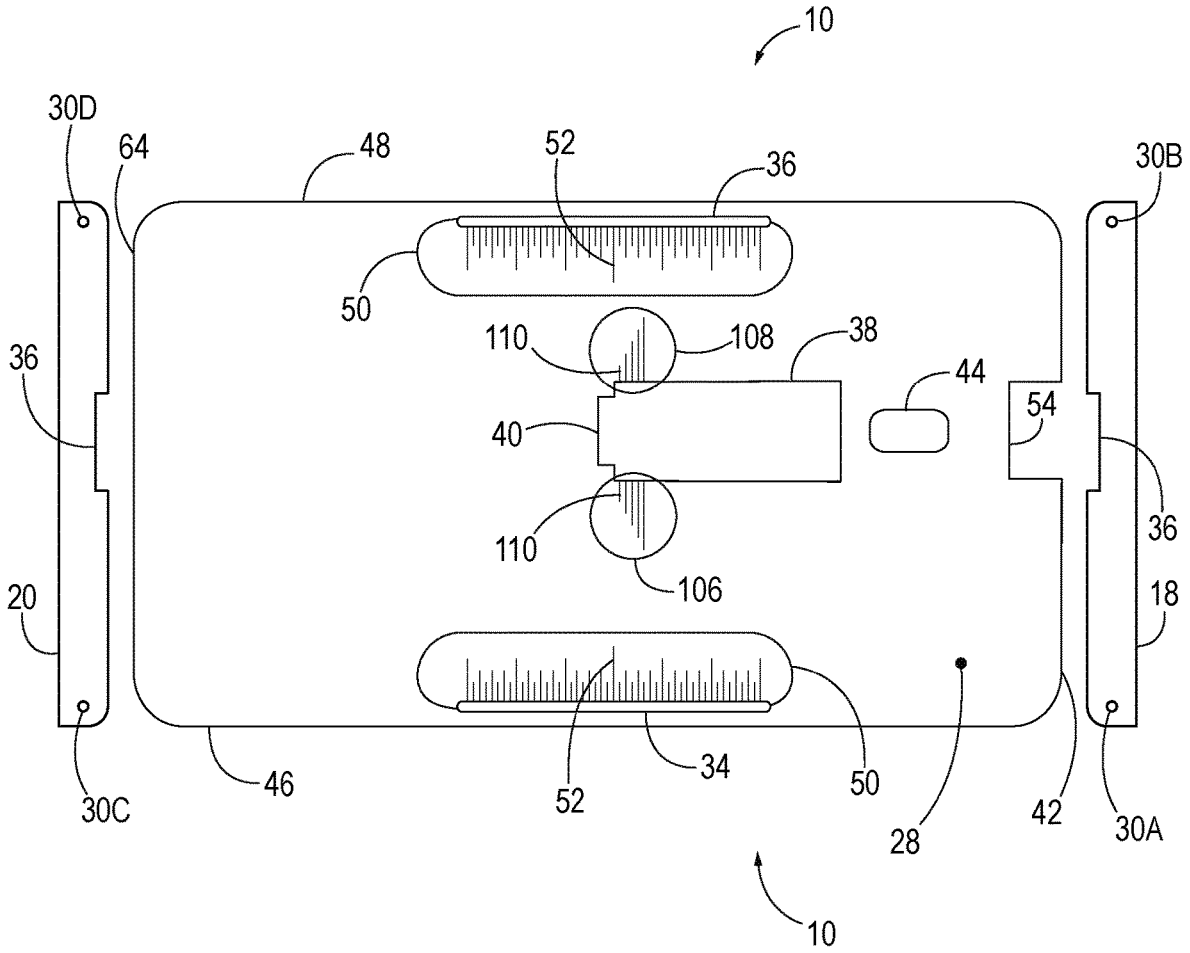

FIG. 7. Shows a plan view of the invention with the guide plates and having a cutout and rectangular edge trim.

Figure 8:
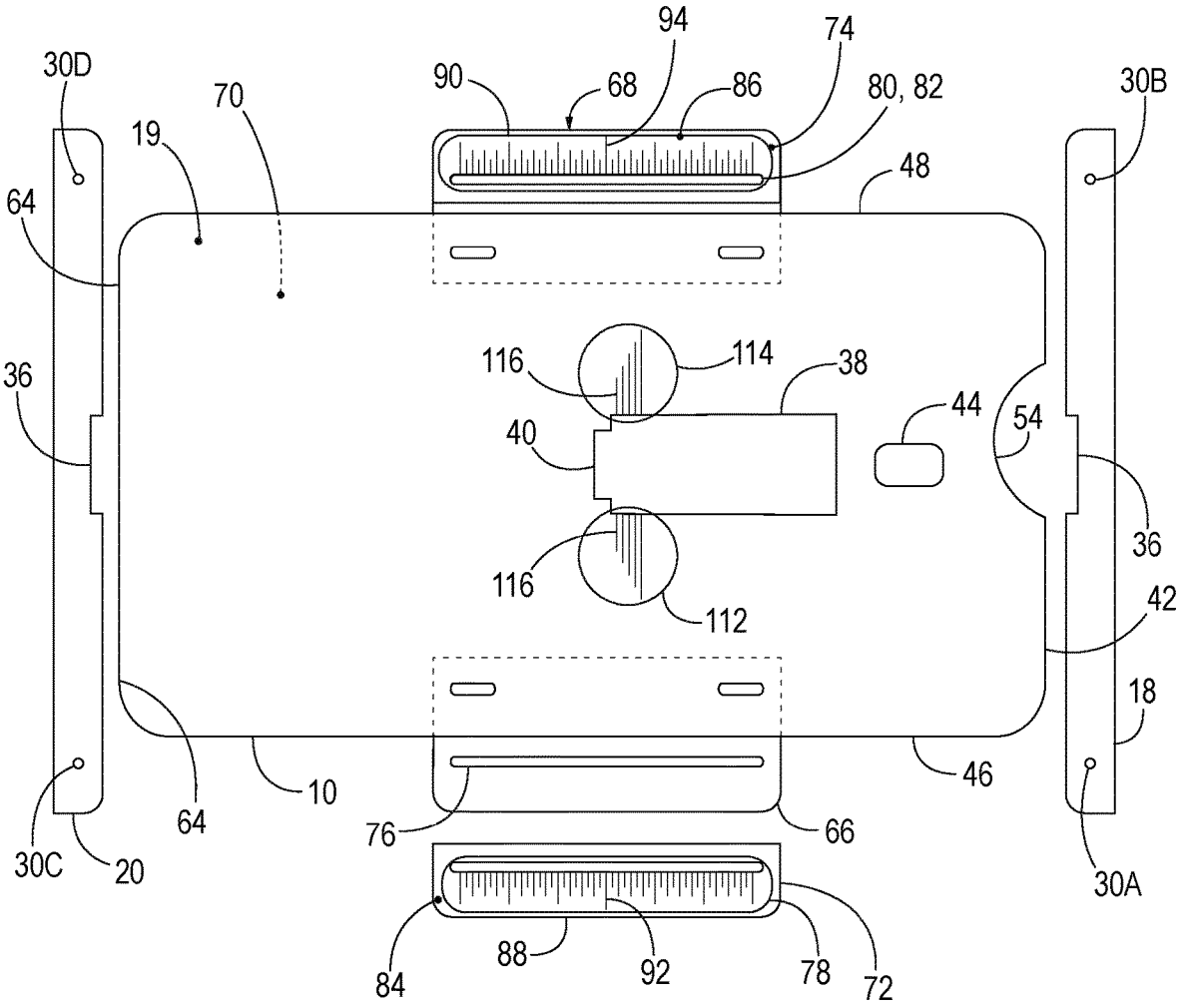

FIG. 8. Shows a plan view of a pair of straps, guides and graduated edge members.

Figure 9:
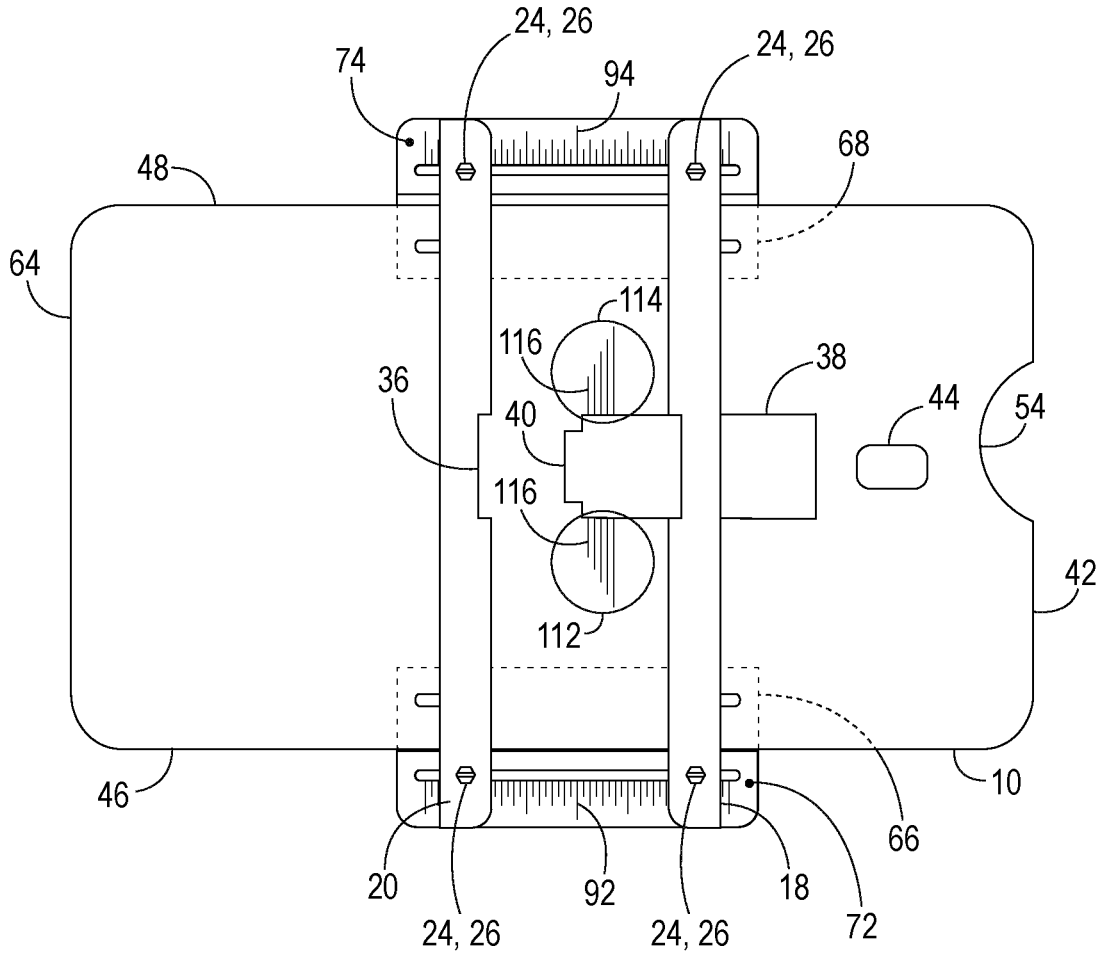

FIG. 9. Shows a assembled view of a FIG. 8.

Figure 10:
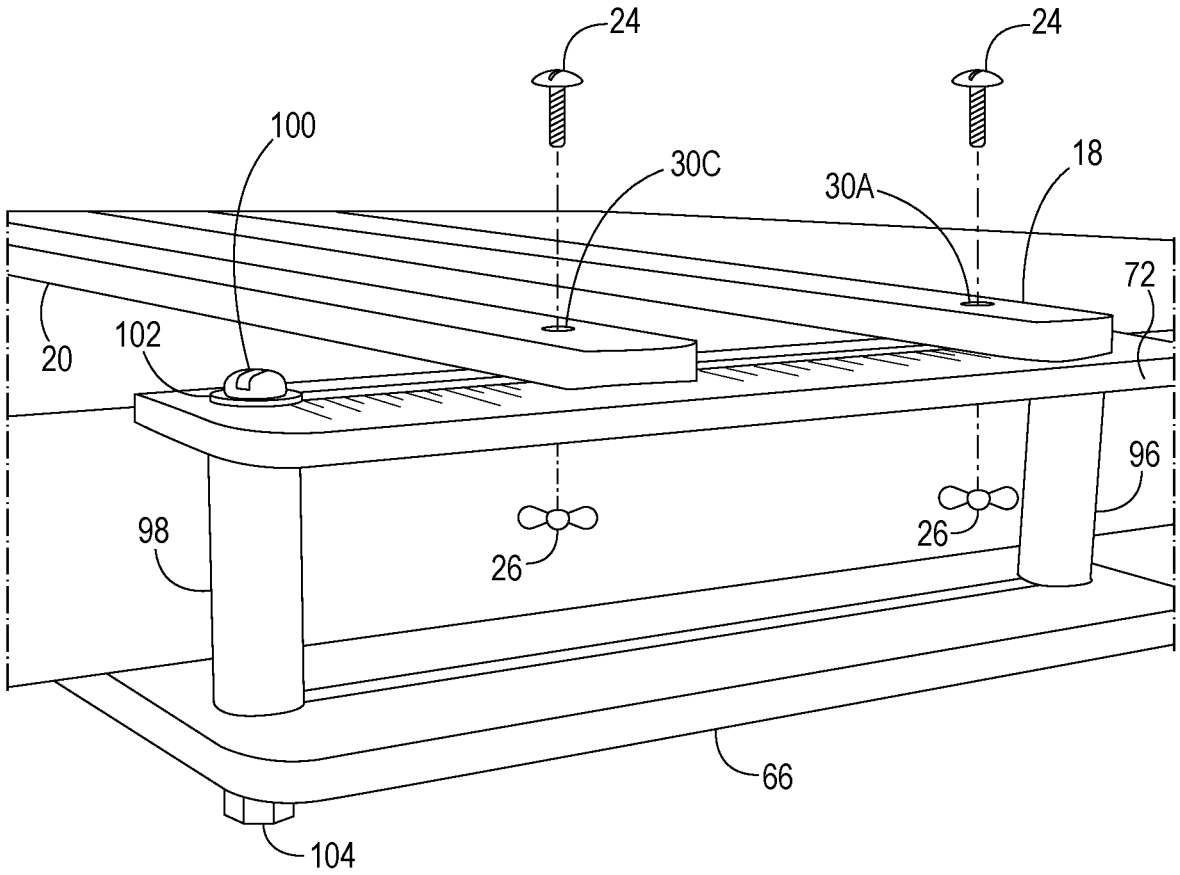

FIG. 10. Shows an edge view of the invention glued onto sewing machine table.

III. DETAILED DESCRIPTION

FIG. 1 shows, a standard sewing machine (1) that is described as a "free arm" or "cylinder arm" style sewing machine. The sewing machine (1) has a slide plate (2) and a throat plate (3), where the bobbin (not shown) and other mechanicals are contained. The sides (4) of the housing (5) for the slide plate (2) and throat plate (3) are angled as designed by the sewing machine manufacturer. Approximately centrally located on the sewing machine (1) casing, the manufacturer has placed a boss (6) that protrudes upwards and contains 2 (two) holes (7) that are internally threaded to allow standard screws (not shown) to be threadably inserted therein.

With respect to FIG. 2, we show the sewing machine (1) with the object of this application, the sewing machine table (10) installed onto the sewing machine (1). The sewing machine table (10) is held in place by an attachment plate (12), where the attachment plate (12) has at least one threaded fastener (screw or bolt) (14) threadably inserted through one of the two holes (16) in the attachment plate (12) that match the holes (7) in the boss (6) on the sewing machine (1). Also shown in FIG. 2 is a first guide plate (18) and a second guide plate (20). The first guide plate (18) and the second guide plate (20) each have holes (30) located on each end of the first and second guide plates (18, 20). The fasteners shown (22) each contain a screw (24) and a complimentary nut (26).

FIG. 3 shows a closeup of the installed sewing machine table (hereinafter table) (10) depicting the first guide plate (18) and the second guide plate (20) slideably installed onto the sewing machine table (10). The first and second guide plate (18, 20) is shown on a top surface (28) of the sewing machine table (10). The first guide plate (18) has holes (30A, 30B) and the second guide plate (20) has holes (30C, 30D) defined therein. The sewing machine table (10) has a first slot (32) and a second slot (34) defined where the first and second holes (30A, 30B) in the first guide plate (18), and the third and fourth holes (30C, 30D) in the second guide plate (20) and the screws (24) allow the first and second guide plates (18, 20) to slide. When the screws (24) are inserted through the holes (30A, 30B, 30C, 30D) and the first and second slots (32, 34) and the nut (26) is then threadably installed and tightens the first and second guide plates (18, 20) which then press down on the top surface (28) of the sewing machine table (10) locking the first and second guide plates (18, 20) in place.

Located on the first and second guide plates (18, 20) is a clearance slot (36), where the clearance slot has a length "L" and a width "W" that is sized to allow a presser foot (8) to freely move while the sewing machine (1) is in use. FIG. 3 shows that the clearance slot (32) in the first and second guide plates (18, 20) face each other to allow a strap or hem of smaller width to be sewn.

FIG. 4 shows a plan view of the sewing machine table (10) and the first and second (18, 20) guide plates. The table (10) is shown with an essentially rectangular shape and may have rounded corners. A central cutout (38) is shown that is essentially rectangular in shape and located approximately 4.26 inches (108.35 mm) from the first edge (42) of the sewing machine table (10). The central cutout (38) in this embodiment has an approximate width of 2.07 inches (52.58 mm) and an approximate length of 5.65 inches (118.11 mm) The central cutout (38) also has a notch (40) added, where the notch (40) essentially provides clearance to the sewing machine (1) throat plate (3). The notch (40) in this embodiment has an approximate length of 1.41 inches (35.81 mm) and an approximate width of 0.34 inches (8.89 mm) The noted length and width of the central cutout (38) is to assure that the cutout will rest on the sides (4) of the sewing machine (1) providing support when attached. The dimensions of the notch (40) for this embodiment are to assure clearance to the throat plate (3) on the sewing machine (1). A clearance hole (44) is shown in the sewing machine table (10), where the clearance hole (44) is sized to clear the boss (6) on the sewing machine. The positions of the central cutout (38), notch (40), and clearance hole (44) are set for specific manufacturers. The clearance hole (40), the central cutout (38), and the notch (40) are biased towards the third edge (48) and are aligned so as to provide increased working area for a user Continuing with FIG. 4, we have a second edge (46) and a third edge (48), where the second and third edges (46, 48) are opposing and parallel to each other. The first slot (32) is in close proximity to the second edge (46) and the second slot (34) is in close proximity to the third edge (48). The first and second slots (32, 34) are essentially parallel to each other and are of the same width and length. Scribed onto the top surface (28) of the sewing machine table (10) are ruled markings (50). The ruled markings (50) can be in English (inches) or Metric (centimeters/millimeters). There are two sets of ruled markings (50) that are opposed to each other and in close proximity to the first and second slot (32, 34). The ruled markings (50) have a centerline (52) where the centerlines of the ruled markings (50) are in line with each other and the needle (9) (not shown) of the sewing machine (1) (not shown).

FIG. 4 shows the first guide plate (18) and the second guide plate (20). The first guide plate (18) has holes (30A, 30B) at opposing ends of the first guide plate (18) and the second guide plate (20) has holes (30C, 30D) at opposing ends of the second guide plate (20). The clearance slot (36) on both the first guide plate and second guide plate (18, 20) is shown to be biased towards the third edge (48) of the sewing machine table (10). This bias allows for the notch (40) on the first and second guide plates (18, 20) to maintain clearance to the presser foot (8), and the needle (9) on the sewing machine (1) when in use.

Added in close proximity to the central cutout (38) on the top surface (28) of the table (10) is a second and third set of ruled markings (106, 108), where the second and third set of ruled markings (106, 108) may be in English (inches) or Metric (centimeters/millimeters) units to match the ruled markings (50) common to the first and second slots (32, 34). The leader line (110) of the second and third set of ruled markings (106, 108) is spaced away from the needle (9) and aligns with the markings (50) on the top surface (28) of the sewing machine table (10). Typically, the leader line (110) is ⅛ inch (3.127 mm) away from the needle (9).

FIG. 5 shows the same embodiment as FIG. 4 and adds an additional clearance trim to the sewing machine table (10). FIG. 5 shows the plan view of the sewing machine table (10) and the first and second (18, 20) guide plates. The table (10) is shown with an essentially rectangular shape and may have rounded corners. A central cutout (38) is shown that is essentially rectangular in shape and located approximately 4.26 inches (108.35 mm) from the first edge (42) of the sewing machine table (10). The central cutout (38) in this embodiment has an approximate width of 2.07 inches (52.58 mm) and an approximate length of 5.65 inches (118.11 mm) The central cutout (38) also has a notch (40) added, where the notch (40) essentially provides clearance to the sewing machine (1) throat plate (3). The notch (40) in this embodiment has an approximate length of 1.41 inches (35.81 mm) and an approximate width of 0.34 inches (8.89 mm) The noted length and width of the central cutout (38) is to assure that the cutout will rest on the sides (4) of the sewing machine (1) providing support when attached. The dimensions of the notch (40) for this embodiment are to assure clearance to the throat plate (3) on the sewing machine (1). A clearance hole (44) is shown in the sewing machine table (10), where the clearance hole (44) is sized to clear the boss (6) on the sewing machine. The positions of the central cutout (38), notch (40), and clearance hole (44) are set for specific manufacturers. A clearance trim (54) is shown on the first edge (42). The clearance trim (54) is sized to clear the sewing machine (1) and is shown to be circular. The clearance hole (44), the central cutout (38), the notch (40), and the clearance trim (54) are biased towards the third edge (48) and are aligned.

Continuing with FIG. 5, we have a second edge (46) and a third edge (48), where the second and third edges (46, 48) are opposing and parallel to each other and are of the same width and length. The first slot (32) is in close proximity to the second edge (46) and the second slot (34) is in close proximity to the third edge (48). The first and second slots (32, 34) are essentially parallel to each other. Scribed onto the top surface (28) of the sewing machine table (10) are ruled markings (50). The ruled markings (50) can be in English (inches) or Metric (centimeters/millimeters). There are two sets of ruled markings (50) that are opposed to each other and in close proximity to the first and second slot (32, 34). The ruled markings (50) have a centerline (52) where the centerlines of the ruled markings (50) are in line with each other and the needle (9) (not shown) of the sewing machine (1) (not shown).

FIG. 5 shows the first guide plate (18) and the second guide plate (20). The first guide plate (18) has holes (30A, 30B) at opposing ends of the first guide plate (18) and the second guide plate (20) has holes (30C, 30D) at opposing ends of the second guide plate (20). The clearance slot (36) on both the first guide plate and second guide plate (18, 20) is shown to be biased towards the third edge (48) of the sewing machine table (10). This bias allows for the notch (40) on the first and second guide plates (18, 20) to maintain clearance to the presser foot (8), and the needle (9) on the sewing machine (1) when in use.

Added in close proximity to the central cutout (38) on the top surface (28) of the table (10) is a second and third set of ruled markings (106, 108), where the second and third set of ruled markings (106, 108) may be in English (inches) or Metric (centimeters/millimeters) units to match the ruled markings (50) common to the first and second slots (32, 34). The leader line (110) of the second and third set of markings (106, 108) is spaced away from the needle (9) and aligns with the markings (50) on the top surface (28) of the sewing machine table (10). Typically, the leader line (110) is ⅛ inch (3.127 mm) away from the needle (9).

FIG. 6 shows a modification that is adapted to fit a different type of sewing machine. FIG. 6 is similar to FIG. 4. FIG. 6 shows the plan view of the sewing machine table (10) and the first and second (18, 20) guide plates. The table (10) is shown with an essentially rectangular shape and may have rounded corners. A central cutout (38) is shown that is essentially rectangular in shape and located approximately 4.26 inches (108.35 mm) from the first edge (42) of the sewing machine table (10). The central cutout (38) in this embodiment is rectangular in shape and is sized to fit the throat plate and accessory plate (not shown) of a specific sewing machine manufacturer. The rectangular shape of the central cutout (38) is to assure that the cutout will rest on the sides (4) of a sewing machine and provide support when attached. The sewing machine table (10) has a pair of elongated slots (56) shown. The elongated slots (56) are spaced to align with a pair of threaded holes (not shown) in a sewing machine (not shown). A spacer plate (58) is shown glued or fastened to the bottom surface of the sewing machine table (10). The spacer plate (58) is shown is rectangular in shape and has a first trim (60) and a second trim (62) being positioned by the elongated slots (56) and allow adequate clearance for fasteners (not shown) to pass through the elongated slots (56) and the first and second trim (60, 62) without interference from the spacer plate (58). The spacer plate (58) has a thickness that provides support for the sewing machine table (10) when threadably attached to the sewing machine (not shown), and assures that the sewing machine table (10) is level when attached to a sewing machine (not shown). The positions of the central cutout (38), notch (40), elongated holes (56), and spacer plate (58) is set for specific manufacturers. The elongated holes (56), the spacer plate (58), the central cutout (38), and the notch (40), are biased towards the third edge (48) and are aligned to each other.

Continuing with FIG. 6, we have a second edge (46) and a third edge (48), where the second and third edges (46, 48) are opposing and parallel to each other and are of the same width and length. The first slot (32) is in close proximity to the second edge (46) and the second slot (34) is in close proximity to the third edge (48). The first and second slots (32, 34) are essentially parallel to each other. Scribed onto the top surface (28) of the sewing machine table (10) are ruled markings (50). The ruled markings (50) can be in English (inches) or Metric (centimeters/millimeters). The two sets of ruled markings (50) are opposed to each other and in close proximity to the first and second slot (32, 34). The ruled markings (50) have a centerline (52) where the centerlines of the ruled markings (50) are in line with each other and the needle (9) (not shown) of the sewing machine (1) (not shown).

FIG. 6 further shows the first guide plate (18) and the second guide plate (20). The first guide plate (18) has holes (30A, 30B) at opposing ends of the first guide plate (18) and the second guide plate (20) has holes (30C, 30D) at opposing ends of the second guide plate (20). The clearance slot (36) on both the first guide plate and second guide plate (18, 20) is shown to be biased towards the third edge (48) of the sewing machine table (10). This bias allows for the notch (40) on the first and second guide plates (18, 20) to maintain clearance to the presser foot (8), and the needle (9) on the sewing machine (1) when in use.

Added in close proximity to the central cutout (38) on the top surface (28) of the table (10) is a second and third set of ruled markings (106, 108), where the second and third set of ruled markings (106, 108) may be in English (inches) or Metric (centimeters/millimeters) units to match the ruled markings (50) common to the first and second slots (32, 34). The leader line (110) of the second and third set of markings (106, 108) is spaced away from the needle (9) and aligns with the markings (50) on the top surface (28) of the sewing machine table (10). Typically, the leader line (110) is ⅛ inch (3.127 mm) away from the needle (9).

FIG. 7 shows the same embodiment as FIG. 5 and is adapted to fit a different style of sewing machine (1). FIG. 7 shows the plan view of the sewing machine table (10) and the first and second (18, 20) guide plates. The table (10) is shown with an essentially rectangular shape and may have rounded corners. A central cutout (38) is shown that is essentially rectangular in shape and located approximately 4.26 inches (108.35 mm) from the first edge (42) of the sewing machine table (10). The central cutout (38) in this embodiment has an approximate width of 2.07 inches (52.58 mm) and an approximate length of 5.65 inches (118.11 mm) The central cutout (38) also has a notch (40) added, where the notch (40) essentially provides clearance to the sewing machine (1) throat plate (8). The notch (40) in this embodiment has an approximate length of 1.41 inches (35.81 mm) and an approximate width of 0.34 inches (8.89 mm). The noted length and width of the central cutout (38) is to assure that the cutout will rest on the sides (4) of the sewing machine (1) providing support when attached. The dimensions of the notch (40) for this embodiment are to assure clearance to the throat plate (3) on the sewing machine (1). A clearance hole (44) is shown in the sewing machine table (10), where the clearance hole (44) is sized to clear the boss (6) on the sewing machine. The positions of the central cutout (38), notch (40), and clearance hole (44) are set for specific manufacturers. A clearance trim (54) is shown on the first edge (42). The clearance trim (54) is sized to clear the sewing machine (1) and in this embodiment is a squared off trim. The clearance hole (40), the central cutout (38), the notch (40), and the clearance trim (54) are biased towards the third edge (48) and are aligned.

Continuing with FIG. 7, we have a second edge (46) and a third edge (48), where the second and third edges (46, 48) are opposing and parallel to each other and are of the same width and length. The first slot (32) is in close proximity to the second edge (46) and the second slot (34) is in close proximity to the third edge (48). The first and second slots (32, 34) are essentially parallel to each other. Scribed onto the top surface (28) of the sewing machine table (10) are ruled markings (50). The ruled markings (50) can be in English (inches) or Metric (centimeters/millimeters). There are two sets of ruled markings (50) that are opposed to each other and in close proximity to the first and second slot (32, 34). The ruled markings (50) have a centerline (52) where the centerlines of the ruled markings (50) are in line with each other and the needle (9) (not shown) of the sewing machine (1) (not shown).

FIG. 7 shows the first guide plate (18) and the second guide plate (20). The first guide plate (18) has holes (30A, 30B) at opposing ends of the first guide plate (18) and the second guide plate (20) has holes (30C, 30D) at opposing ends of the second guide plate (20). The clearance slot (36) on both the first guide plate and second guide plate (18, 20) is shown to be biased towards the third edge (48) of the sewing machine table (10). This bias allows for the notch (40) on the first and second guide plates (18, 20) to maintain clearance to the presser foot (8), and the needle (9) on the sewing machine (1) when in use. Added in close proximity to the central cutout (38) on the top surface (28) of the table (10) is a second and third set of ruled markings (106, 108), where the second and third set of ruled markings (106, 108) may be in English (inches) or Metric (centimeters/millimeters) units to match the ruled markings (50) common to the first and second slots (32, 34). The leader line (110) of the second and third set of markings (106, 108) is spaced away from the needle (9) and aligns with the markings (50) on the top surface (28) of the sewing machine table (10). Typically, the leader line (110) is ⅛ inch (3.127 mm) away from the needle (9).

FIG. 8 shows the same embodiment as FIG. 5, and shows the plan view of the sewing machine table (10) and the first and second (18, 20) guide plates. The table (10) is shown with an essentially rectangular shape and may have rounded corners. A central cutout (38) is shown that is essentially rectangular in shape and located approximately 4.26 inches (108.35 mm) from the first edge (42) of the sewing machine table (10). The central cutout (38) in this embodiment has an approximate width of 2.07 inches (52.58 mm) and an approximate length of 5.65 inches (118.11 mm). The central cutout (38) also has a notch (40) added, where the notch (40) essentially provides clearance to the sewing machine (1)

presser foot (8). The notch (40) in this embodiment has an approximate length of 1.41 inches (35.81 mm) and an approximate width of 0.34 inches (8.89 mm) and is located towards the fourth edge (64). The noted length and width of the central cutout (38) is to assure that the cutout will rest on the sides (4) of the sewing machine (1) providing support when attached. The dimensions of the notch (40) for this embodiment are to assure clearance to the throat plate (3) on the sewing machine (1). A clearance hole (44) is shown in the sewing machine table (10), where the clearance hole (44) is sized to clear the boss (6) on the sewing machine. The positions of the central cutout (38), notch (40), and clearance hole (44) are set for specific manufacturers. A clearance trim (54) is shown on the first edge (42). The clearance trim (54) is sized to clear the body of the sewing machine (1) and is shown to be circular but also may be rectangular in shape to clear the sewing machine. The clearance hole (44), the central cutout (38), the notch (40), and the clearance trim (54) are biased towards the third edge (48) and are aligned.

Continuing with FIG. 8, we have a second edge (46) and a third edge (48), where the second and third edges (46, 48) are opposing and parallel to each other. A first support plate (66) is shown, where the first support plate (66) is adhered or fastened to the bottom (70) of the sewing machine table (10). Placed on top of the first support plate (66) is a first slide plate (72). The first support plate (66) has a first slot (76) defined therein. The first slide plate (72) has a second slot (78) defined therein. The first and second support slots (76, 78) in the first support plate (66) and the first slide plate (72) are generally of the same length and width. The length of the first support plate (66) and the first slide plate (72) are generally the same. When the first support plate (66) and the first slide plate (72) are mated, the first and second slots (76, 78) are aligned and the edges of the first support plate (66) and the first slide plate (72) are aligned. The first support plate (66) and the first slide plate (72) are glued or fastened together.

Opposing the first support plate (66) and the first slide plate (72) are the second support plate (68) and the second slide plate (74). The second support plate (68) has a third slot (80) defined therein and is glued or fastened to the bottom surface (70) of the sewing machine table (10). The second slide plate (74) has a fourth slot (82) defined therein where the third and fourth slots (80, 82) are of the same width and length. The second slide plate (74) is aligned with the edges of the second support plate (68) wherein the third and fourth slots (80, 82) are fully aligned. The edges of the first support plate and first slide plate (66, 72) are aligned with the second support plate (68) and second slide plate (74). Scribed onto a top surface (84) of the first slide plate (72) are a first set of ruled markings (88). The first set of ruled markings (88) can be in English (inches) or Metric (centimeters/millimeters). Scribed onto a top surface (86) of the second slide plate (74) is a second set of ruled markings (90). The second set of ruled markings (90) can be in English (inches) or Metric (centimeters/millimeters). The first and second sets of ruled markings (88, 90) each have a have a centerline (92, 94) where the centerlines of the ruled markings (72, 74) are in line with each other and the needle (9) (not shown) of the sewing machine (1) (not shown).

FIG. 8 further shows the first guide plate (18) and the second guide plate (20). The first guide plate (18) has holes (30A, 30B) at opposing ends of the first guide plate (18) and the second guide plate (20) has holes (30C, 30D) at opposing ends of the second guide plate (20). The clearance slot (36) on both the first guide plate and second guide plate (18, 20) is shown to be biased towards the third edge (48) of the sewing machine table (10). This bias allows for the notch (40) on the first and second guide plates (18, 20) to maintain clearance to the presser foot (8) (not shown), and the needle (9) (not shown) on the sewing machine (1) when in use.

Added in close proximity to the central cutout (38) on the top surface (28) of the table (10) is a third and fourth set of ruled markings (112, 124), where the third and fourth set of ruled markings (112, 124) may be in English (inches) or Metric (centimeters/millimeters) units to match the ruled markings (88, 90) common to the first and second slots (32, 34). The leader line (116) of the third and fourth set of markings (112, 114) is spaced away from the needle (9) and aligns with the markings (88, 90) on the top surface (28) of the sewing machine table (10). Typically, the leader line (110) is ⅛ inch (3.127 mm) away from the needle (9).

Referring to FIG. 9, we show the sewing machine table (10) as described in FIG. 8 fully assembled. The first guide plate (18) is shown with a screw (24) in each of holes (30A, 30B) going through the first and second slots (76, 78) in the first support plate (66) and first guide plate (72). The nuts (26) are on the bottom surface of the first and second support plate (66, 68). The second guide plate (20) is shown with a screw (24) in each of holes (30C, 30D) going through the third and fourth slots (80, 82) in the second support plate (68) and second guide plate (74). The nuts (26) are on the bottom surface of the first and second support plate (66, 68). The first and second guide plates (18, 20) are shown with the notches (40) on the first and second guide plates (18, 20) facing each other.

Regarding FIG. 10, we expand on the disclosure of FIG. 9 to accommodate an extra thick integrally attached sewing machine table. We show the first support plate (66) glued to the bottom of a sewing machine table that is integral with the sewing machine (1) similar to what was described in FIG. 9. Typically, these tables are much thicker than the sewing machine table (10) disclosed in FIG. 4 thru FIG. 8. A first sleeve (96) and second sleeve (98) are shown providing support and a gap between the first slide plate (72) and the first support plate (66). A screw (100), washer (102), and nut (104) positionally secure the slide plate (72) to the support plate (66). As previously described in FIG. 9, the first support plate (66) has a first slot (76) defined and the first slide plate (72) has a second slot (78) defined where the first and second slots (76, 78) are of the same width and length and are positionally aligned to each other. Although one edge is shown, there is an opposing edge of the sewing machine table (not shown) that attaches the second support plate (68) and second slide plate (74) using the same sleeves (96, 98) as previously described. The second support plate (68) has a third slot (80) and the second slide plate (74) has a fourth slot (82). The third and fourth slots (80, 82) have the same width and length and are positionally aligned to each other. A screw (100), a washer (102), and a nut (104) positionally secure the second slide plate (74) to the second support plate (68) on the opposing side of the sewing machine table. The first and second guide plates (18, 20) are secured to the first and second slide plates (72, 74) using screws (24) and nuts (26).

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

What is claimed is:

1. A sewing machine table, comprising:

a table having a rectangular shape, the table having a top surface and a bottom surface and further having a first edge, a second edge a third edge and a fourth edge;

a) the table having a rectangular central cutout defined therein, the rectangular cutout being sized to provide clearance to a slide plate and a throat plate for a sewing machine, the central cutout further having a notch defined therein, the notch being sized to provide clearance to the sewing machine throat plate;

b) the table further having a means to secure the table to the sewing machine;

c) the table having a first slot, the first slot being biased towards the second edge of the table, and a second slot, the second slot being biased towards the third edge of the table, the first slot and the second slot having the same width and length and positionally opposing each other; and d) the table having a first guide plate and a second guide plate, the first and second guide plate each having a first hole and a second hole defined therein, the first and second hole of the first and second guide plate are positioned on opposing ends of the guide plates, the first and second guide plate each have a clearance slot defined therein, the clearance slot configured to provide clearance to a presser foot on the sewing machine, the first and second guide plate each have a screw and a nut to fasten the guide plate using the first and second hole through the first and second slots.

2. The sewing machine table of claim 1 further having two sets of ruled markings scribed onto the top surface of the sewing machine table, the two sets of ruled markings are positionally opposed to each other and each are adjacent to the first and second slots on the table, each of the two sets of ruled markings have a centerline scribed therein where the centerlines of the ruled markings are in line with each other and are configured to be in line with a needle of the sewing machine.

3. The sewing machine table of claim 2 further having a second and third set of ruled markings, the second and third set of ruled markings being scribed onto the top surface of the sewing machine table, the second and third set of ruled markings are positionally opposed to each other and each are adjacent to the central cutout on the table, the second and third set of ruled markings each has a leader line and are spaced away from the centerline of the two sets of ruled markings and are aligned with the two sets of ruled markings.

4. The sewing machine table of claim 3 wherein the means to secure the table to the sewing machine consists of the sewing machine table having a clearance hole defined therein, the clearance hole is positionally biased towards the first edge of the table configured to thereby allowing a boss on the sewing machine, to reside therein, an attachment plate, the attachment plate being secured onto the top surface of the table and having at least one hole defined therein, the hole being configured to align holes in the boss of the sewing machine, the hole allowing a threaded fastener to penetrate therethrough and fasten the table to the sewing machine, the rectangular cutout, the notch, the clearance hole, and the attachment plate being aligned to each other.

5. The sewing machine table of claim 4, wherein the means to secure the table to the sewing machine consists of two elongated slots, the two elongated slots being configured to align with the holes in the boss of the sewing machine, a spacer plate, the spacer plate being adhered to the bottom surface of the table, the spacer plate having a first trim and a second trim defined therein, the first and second trim being aligned to the two elongated slots in the table, and each allowing at least one threaded screw to penetrate each of the elongated slots to threadably attach the table to the sewing machine, wherein the elongated slots, the spacer plate, the central cutout, and the notch are aligned to each other.

6. The sewing machine table of claim 5, further comprising a clearance trim, the clearance trim being located on the first edge of the sewing machine table, the clearance trim being aligned with the rectangular cutout, the notch, the clearance hole, and the attachment plate.

7. The sewing machine table of claim 6, wherein the clearance trim is circular and configured to clear the body of the sewing machine.

8. The sewing machine table of claim 6, wherein the clearance trim is rectangular and configured to clear the body of the sewing machine.

9. A sewing machine table, comprising:

a table having a rectangular shape, the table having a top surface and a bottom surface and further having a first edge, a second edge a third edge and a fourth edge;

a) the table having a rectangular central cutout defined therein, the rectangular cutout being sized to provide clearance to a slide plate and a throat plate for a sewing machine, the central cutout further having a notch defined therein, the notch being sized to provide clearance to the sewing machine throat plate;

b) the table further having a means to secure the table to the sewing machine;

c) the table having a first support plate having a first slot defined therein, the first support plate being secured to the bottom surface of the sewing machine table, and also having a second support plate having a second slot defined therein, the second support plate being secured to the bottom surface of the sewing machine, the first slot and the second slot having the same width and length and being positionally opposed to each other;

d) the table having a first slide plate and a second slide plate, the first slide plate has a third slot defined therein and the second slide plate has a fourth slot defined therein, the first slide plate has a first set of ruled markings scribed on a top surface of the first slide plate and the second slide plate has a second set of ruled markings scribed on a top surface of the second slide plate;

e) the first slide plate and second slide plate each has a means to be attached to the first and second support plate; and f) the table having a first guide plate and a second guide plate, the first and second guide plate each having a first hole and a second hole defined therein, the first and second hole of the first and second guide plate are positioned on opposing ends of the guide plates, the first and second guide plate each have a clearance slot defined therein, the clearance slot configured to provide clearance to a presser foot on the sewing machine, the first and second guide plate each have a screw and a nut to fasten the first and second guide plate using the first and third slot of the first and second support plate and the second and fourth slot of the first and second slide plate.

10. The sewing machine table of claim 9, where the first and second set of ruled markings are positionally opposed to each other and each are adjacent to the third and fourth slots on the first and second slide plates, each of the two sets of ruled markings have a centerline scribed therein where the centerlines of the first and second set of ruled markings are in line with each other and with the needle of the sewing machine.

11. The sewing machine table of claim 10 further having a third and fourth set of ruled markings, the third and fourth set of ruled markings being scribed onto the top surface of the sewing machine table, the third and fourth set of ruled markings are positionally opposed to each other and each are adjacent to the central cutout on the table, the third and fourth set of ruled markings each has a leader line and are spaced away from the centerline of the first and second sets of ruled markings and are aligned with the first and second sets of ruled markings.

12. The sewing machine table of claim 9 wherein the means to secure the table to a sewing machine consists of the sewing machine table having a clearance hole defined therein, the clearance hole is positionally biased towards the first edge of the table and is configured to thereby allow a boss on the sewing machine to reside therein, an attachment plate, the attachment plate being secured onto the top surface of the table and having at least one hole defined therein, the hole being configured to align holes in the boss of the sewing machine, the hole allowing a threaded fastener to penetrate therethrough and fasten the table to the sewing machine, the rectangular cutout, the notch, the clearance hole, and the attachment plate being aligned to each other.

13. The sewing machine of claim 12, wherein the means to secure the table to the sewing machine consists of two elongated slots, the two elongated slots being configured to align with the holes in the boss of the sewing machine, a spacer plate, the spacer plate being adhered to the bottom surface of the table, the spacer plate having a first trim and a second trim defined therein, the first and second trim being aligned to the two elongated slots in the table, and each allowing at least one threaded screw to penetrate each of the elongated slog and slot to threadably attach the table to the sewing machine, wherein the elongated slots, the spacer plate, the central cutout, and the notch are aligned to each other.

14. The sewing machine table of claim 13, further comprising a clearance trim, the clearance trim being located on the first edge of the sewing machine table, the clearance trim being aligned with the rectangular cutout, the notch, the clearance hole, and the attachment plate and providing clearance to the sewing machine.

15. The sewing machine table of claim 14, wherein the clearance trim is circular and configured to clear the body of the sewing machine.

16. The sewing machine table of claim 14, wherein the clearance trim is rectangular and configured to clear the body of the sewing machine.

17. The sewing machine table of claim 9, wherein the first slide plate is secured onto the first support plate and the second slide plate is secured onto the second support plate.

18. The sewing machine table of claim 9, wherein the first slide plate is secured onto the first support plate using a first and second sleeve where the first and second sleeve maintain a gap between the first support plate and first slide plate, a screw and a washer are inserted through the first slide plate, both sleeves and the first support plate and each are secured by a nut; and a) the second slide plate is secured onto the second support plate using a first and second sleeve where the first and second sleeve maintain a gap between the second support plate and second slide plate, a screw and a washer are inserted through the second slide plate, both sleeves and the second support plate and each are secured by a nut.

* * * * *